United States Patent [19]

Kalthoff

[11] 4,259,944

[45] Apr. 7, 1981

[54] SANITARY HOOD EDGE

[76] Inventor: Charles W. Kalthoff, Rte. 34, Emory Church Rd., Knoxville, Tenn. 37922

[21] Appl. No.: 72,216

[22] Filed: Sep. 4, 1979

[51] Int. Cl.[3] ..... F24C 15/20

[52] U.S. Cl. ..... 126/299 D; 126/299 R; 113/116 W; 113/116 EE

[58] Field of Search ..... 126/299 R, 299 C, 299 D, 126/299 E; 113/1 M, 116 UT, 116 G, 116 EE, 116 W; 219/60, 61, 75

[56] References Cited

U.S. PATENT DOCUMENTS

| | | | |
|---|---|---|---|
| 3,130,661 | 4/1964 | Fischer | 126/299 D |
| 3,769,686 | 11/1973 | Massey | 113/116 W |

FOREIGN PATENT DOCUMENTS

| | | | |
|---|---|---|---|
| 2312305 | 12/1976 | France | 126/299 D |

*Primary Examiner*—James C. Yeung
*Attorney, Agent, or Firm*—Pitts & Kesterson

[57] ABSTRACT

A new, safe and sanitary edge trim for use with commercial ventilation hoods usually located over stoves and ovens is disclosed. The edge trim is particularly suitable for use with ventilation hoods over cooking units where the fumes to be exhausted may carry large amounts of grease and/or fats. The trim of this invention includes a slit cylindrical stainless steel member which tightly fits over the edge of a side wall of the ventilator to which the trim is to be added. The cylindrical member is spot welded to the stainless steel ventilator sidewall with a stainless steel welding rod and a heli-arc welder at spaced locations along the joint. A bead of suitable grease or animal fat imperveous putty or other filler material is located on both surfaces of the ventilator side along the full length of the juncture of the ventilator side and the slit stainless steel cylindrical member. Thus, there is achieved an edge trim which is not hazardous if struck by ones head, and which at the same time prevents the accumulation of grease and animal fat. The edge trim of the prior art ventilator hoods presented both a fire hazard and a location for the growth of germs and bacteria.

6 Claims, 6 Drawing Figures

SANITARY HOOD EDGE

BACKGROUND OF THE INVENTION

This invention relates to a protective trim for use with commercial ventilating units over stoves, ovens and the like. More particular, this invention relates to the trim for the edges of such ventilators to prevent the hazard of inflicting a severe cut on the head of someone accidently impacting the edge of a ventilator. At the same time, the invention eliminates the possibility of the accumulation of grease or animal fat which accumulation presents both a fire hazard and a location for the growth of bacteria and germs.

Until the present invention, commercial ventilating hoods were only able to protect against one of two types of hazards. They either protected against the accumulation of grease and the resulting fire hazard and bacteria growth hazard by providing an unguarded edge, or they protected against the possibility of severe cuts to the head of a person impacting the edge by using a folder over edge to eliminate the risk of cuts. However, it will be appreciated in the case of the unguarded or untrimmed straight edge, severe cuts to the head often resulted if someone were misfortunate enough to impact the edge. On the other hand, if protection against such cuts was attempted by folding the edge over, often an even more severe hazard was created by such a folding edge affording a location for the accumulation of grease and animal fat. Such an accumulation of grease provides an excellent location for the growth of bacteria and germs, thereby resulting in both undesirable odors as well as health problems. Even of more significance, however, is the fact that such accumulation of grease presents a severe fire hazard, which, of course, could have disastrous results.

SUMMARY OF THE INVENTION

Therefore, it is an object of the present invention to provide an attractive edge for a ventilator which edge provides protection against injury due to impact against the edge.

It is another object of the present invention to provide an edge for use with a commercial ventilator which prevents the accumulation of flammable grease and animal fat.

It is still another object of the present invention to provide a edge to a commercial ventilating unit which increases the structural strength of the unit.

It is yet another object of the present invention to provide edge trim to a commercial ventilator which is both simple and inexpensive to fabricate.

Briefly, the protective trim of this invention comprises a ventilator side having two surfaces to which the protective trim is to be applied. The side includes an exposed edge of a selected length and a selected thickness. A cylindrical member defines a slit along its surface, and has a width substantially the same as a thickness of the ventilator side which slit extends along the length of said cylindrical member such that the exposed edge of the ventilator side may be snugly inserted in the slit of the cylindrical member thereby providing a rounded edge or trim to the ventilator side. The cylindrical member and the ventilator side are typically made of suitable corrosive resistant material such as stainless steel. The slit cylindrical trim is permanently attached to the ventilator side by means of welds spaced along the juncture of said slit and both surfaces of said ventilator side. To assure the prevention of grease accumulating between the spaced welds, a grease imperveous putty or material is applied in a bead along the slit of the cylindrical member at its juncture with both surfaces of the side. Welding of the stainless steel ventilator side and the stainless steel slit cylindrical member is accomplished by means of a heli-arc welder and a stainless steel welding rod.

DETAILED DESCRIPTION OF THE INVENTION

Figure 1:
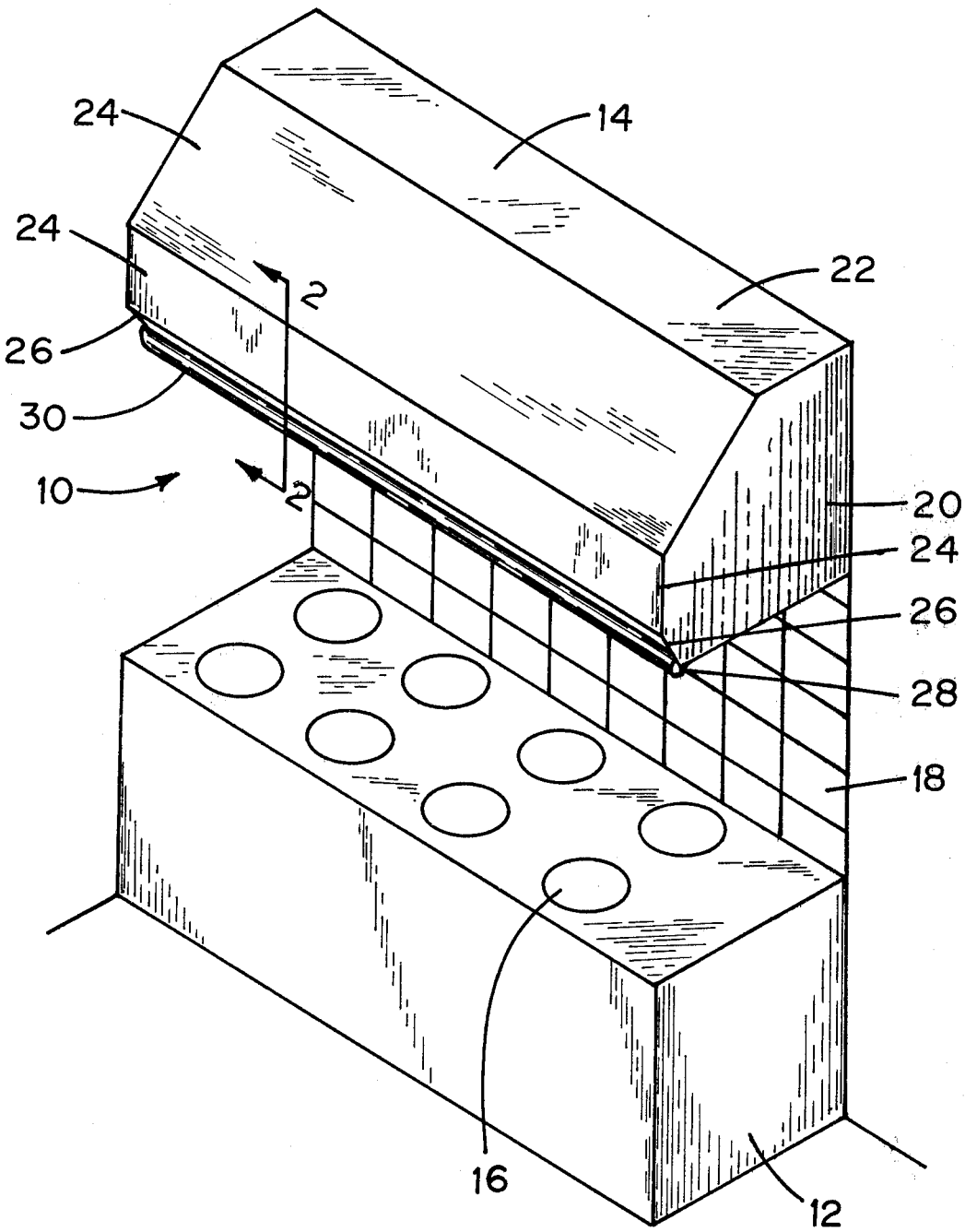
FIG. 1 is a perspective view of a commercial cooking unit having a ventilator which ventilator includes an edge having the new safety trim of this invention.

Referring now to FIG. 1 there is shown generally at 10 a commercial cooking unit 12 and a commercial ventilating unit 14. The cooking unit 12 typically includes several heating elements 16. Also typically included in most such cooking centers is a wall protective member 18. Wall protective member 18 typically covers the wall (not shown) between the cooking unit 12 and the ventilator unit 14 and is unusually made of a corrosive resistant material such as stainless steel. Ventilator unit 14 is typically of closed construction except for the open area directly above the heating elements 16. Thus, as is shown in FIG. 1 there are typically included side panels 20, top panel 22 and front panels 24, 26 and 28. Also included in most ventilating units is an exhaust unit or fan (not shown) which provides a flow path for the fumes from either the back of the ventilating unit or from top panel 22 to a location outside the kitchen. The cooking unit 10 of FIG. 1 also includes the new and unique trim edge 30 of this invention which is shown as being mounted to bottom member 28 of the ventilator unit 14 and which may be clearly seen in FIG. 4. In the embodiment shown, the trim edge of this invention is positioned only on front panel 28. However, it will be appreciated that if desired the trim edge could also be placed on the side panels such as side panel 20.

Figure 2:
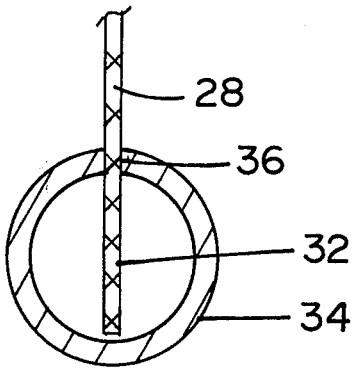
FIG. 2 shows a cross-section of the edge of the ventilator surface covered by the slit cylindrical member having a crimped fit.

Referring now to FIG. 2 there is shown a cross-section of the bottom edge of the ventilator unit side 28 showing the edge trim of this invention. As is shown in FIG. 2 the bottom edge 32 of panel 28 is covered by a cylindrical member 34 which defines a slit 36. The width of slit 36 in cylindrical member 34 has a dimension which is substantially the same or slightly less than the thickness of ventilator side 29. Therefore, it will be appreciated that cylindrical member 34 fits over ventilator side 28 with a very snug or crimp fit. It will further be appreciated that both the ventilator side 28 and the cylindrical member 34 are made of a corrosive resistant material such as stainless steel. Because of its resistance to corrosion and its strength stainless steel is preferred over other materials although other suitable metals could be used.

Figure 3:
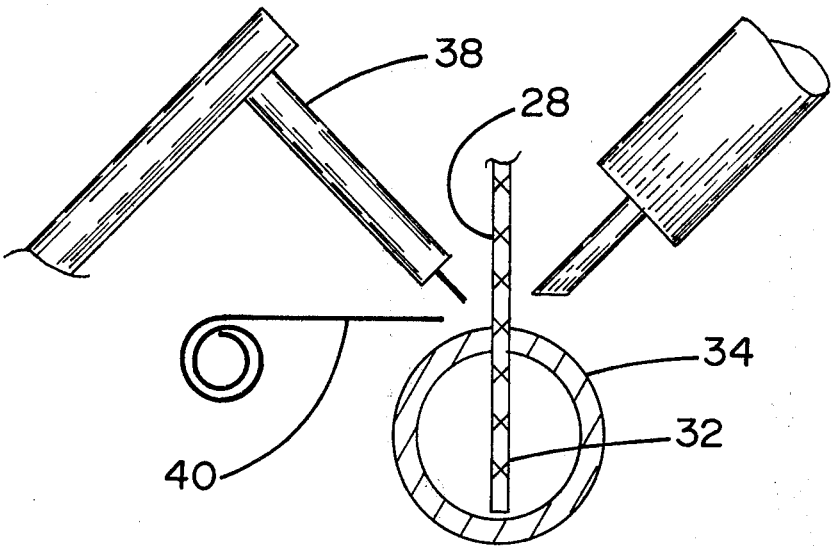
FIG. 3 shows the process by which the slit cylindrical member is permanently attached to the ventilator surface by welding and by which the juncture is made grease imperveous by the addition of the grease imperveous material along said juncture.
Figure 5:
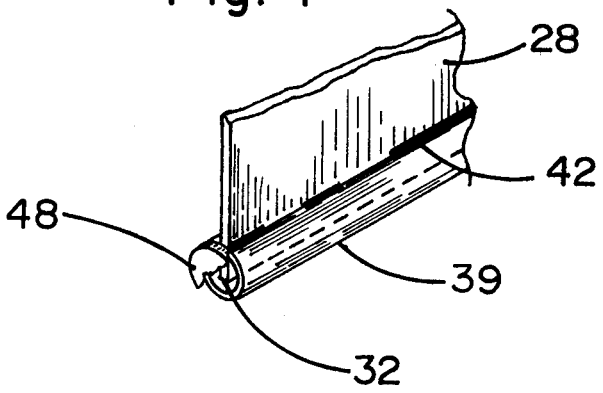
FIG. 5 is a break away view of the ventilator edge covered by the slit cylindrical member and further including an end plate to prevent grease from entering the cylindrical member.
Figure 6:
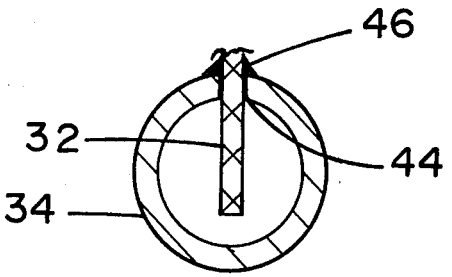
FIG. 6 shows the cross-section of FIG. 2, the welding material which flows in between the juncture, and the bead of grease imperveous cauking material.

Referring now to FIG. 3 there is shown a technique by which the cylindrical member 34 may be permanently attached to the ventilator side 28. As is shown in FIG. 3, cylindrical member 34 is preferably permanently attached to ventilator side 28 by means of a heliarc welder unit 38 and a stainless steel welding rod 40. As is indicated in more detail in FIGS. 5 and 6, heli-arc welds 42 of about one inch in length are made at selected locations about every six inches along the length of cylindrical member 34 and ventilator side 28. As is more clearly shown in FIG. 6, although the term weld has been used and shown in exaggerated form in FIG. 5, the welding material actually tends to flow between the cylindrical member 34 and the ventilator side 28 as is shown by the welding material 44 in FIG. 6. The welds are then smoothed by grinding and polishing.

To further prevent the introduction of grease or animal fat to the interior of the cylindrical member 34 between the spaced welds 42, a bead 46 of suitable grease imperveous putty or cauking material is located at the juncture of both surfaces of ventilator side 28 and cylindrical member 34 thereby providing a complete seal of the interior of cylindrical member 34 against grease or animal fat. Finally, to prevent the possibility of grease entering the interior of cylindrical member 34 at its end points, in an embodiment such as shown in FIG. 1 an end plate 48 is attached at each end of the cylindrical members 34. Typically, the end plate 48 is made of such a size that it provides a forced fit and may be hammered or tapped on with a wooden or rubber mallet. To permanently secure the end plate, it may be welded completely along its circumference to the cylindrical member, as was done with the welds between the ventilator side and the cylindrical member. All of the welds are then ground and polished smooth. The end plate provides both a desirable finish to the trim unit as well as a grease resistant cap.

Figure 4:
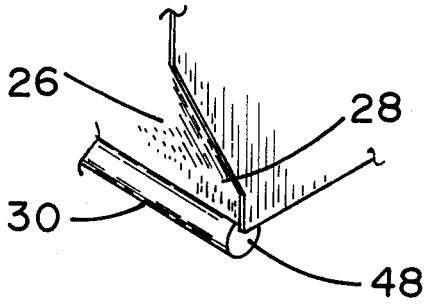
FIG. 4 shows a more detailed perspective view the slit cylindrical member on the front edge of the commercial ventilating unit of FIG. 1.

Referring now to FIG. 4 there is shown a completed trimmed edge according to the teachings of this invention on a commercial ventilator unit such as shown in FIG. 1.

Therefore, while there has been described what at present is considered to be a preferred embodiment of this invention, it will be obvious to those skilled in the art that various changes and modifications may be made thereto without departing from the invention and this application is therefore intended to cover all such changes and modifications as follows in the true spirit and scope of this invention.

I claim:

1. An edge trim for use with a ventilator which protects both against injury due to impact as well as against fire hazards and bacteria growth by preventing the accumulation of grease and animal fat, said edge trim comprising:

a ventilator side having two surfaces and an exposed edge, said side having a selected thickness between said surfaces;

a cylindrical member defining a slit along its surface, said slit having a length suitable for covering a selected portion of said exposed edge, and said slit having a width no greater than said selected thickness of said ventilator side, said exposed edge of said ventilator surface being inserted into said slit such that said cylindrical member covers said selected portion of said exposed edge of said ventilator side;

means for permanently attaching at spaced locations said cylindrical member to said ventilator side to increase the structural strength thereof; and means for providing a grease impervious seal between the juncture of said slit of said cylindrical member and both surfaces of said ventilator side to provide protection against fire hazards and injury due to impact against said edge of said ventilator side.

2. The edge trim of claim 1 and further including an end plate secured to each end of said cylindrical member thereby providing a grease impervious seal.

3. The edge trim of claim 1 or 2 wherein said ventilator side and said cylindrical member are made of stainless steel.

4. The edge trim of claim 1 or 2 wherein said means for permanently attaching is the use of stainless steel welds between said ventilator side and said cylindrical member.

5. The edge trim of claims 1 or 2 wherein said means for providing a grease impervious seal is a bead of grease impervious material located on each surface of said ventilator side at the juncture of said ventilator surfaces and the slit of said cylindrical member.

6. A method for trimming the edge of a ventilator to protect against injury due to impact and against fire hazards and bacteria growth by preventing the accumulation of grease and animal fat, said method comprising the steps of:

providing a ventilator side to be trimmed, said ventilator side having two surfaces and an exposed edge, said side having a selected thickness between said surfaces;

covering a selected portion of said exposed edge with a cylindrical member by inserting said exposed edge in a slit defined along the surface of said cylindrical member, said slit having a width no greater than said selected thickness of said ventilator side whereby said cylindrical member forms a force fit with said ventilator side;

permanently attaching at spaced locations said cylindrical member to said ventilator side;

applying a grease impervious seal at the juncture of said slit of said cylindrical member and both surfaces of said ventilator side to provide protection against fire hazards and injury due to impact against said edge of said ventilator side; and securing an end plate to each end of said cylindrical member to provide a grease impervious seal.

* * * * *